US005301696A

United States Patent [19]

Revson

[11] Patent Number: 5,301,696

[45] Date of Patent: Apr. 12, 1994

[54] DECORATIVE PONY TAIL HOLDER AND METHOD OF USING

[76] Inventor: Rommy H. Revson, 225 E. 57th St., Apt. 19H, New York, N.Y. 10022

[21] Appl. No.: 1,260

[22] Filed: Jan. 6, 1993

[51] Int. Cl.[5] ..... A45D 8/04

[52] U.S. Cl. ..... 132/273; 132/275; 2/174

[58] Field of Search ..... 132/273, 275; 2/174, 2/207, 170, 171, 209.3; D28/41

[56] References Cited

U.S. PATENT DOCUMENTS

| | | | |
|---|---|---|---|
| D. 292,030 | 9/1987 | Revson | D28/41 |
| D. 315,036 | 2/1991 | Leopold | D28/41 |
| D. 315,226 | 3/1991 | Revson | D28/41 |
| 2,105,436 | 1/1938 | Flatto | 132/275 |
| 2,795,232 | 6/1957 | Klein et al. | 132/275 |
| 5,044,385 | 9/1991 | Rhodes | 132/275 |
| 5,144,696 | 9/1992 | Kahl | 2/207 |
| 5,156,171 | 10/1992 | Goodman | 132/273 |

OTHER PUBLICATIONS

McCalls Crafts Catalog, 1987 Fabric Jewelry.

*Primary Examiner*—Gene Mancene
*Assistant Examiner*—Frank A. LaViola
*Attorney, Agent, or Firm*—Gerard F. Dunne

[57] ABSTRACT

A decorative pony tail holder for securely holding the hair of a user includes a band of elastic material with fabric surrounding the band and forming a plurality of radial projections extending circumferentially around a portion of the band. The pony tail holder may thus be secured to the hair by twisting the elastic band into a generally figure-eight configuration and folding it over itself to provide a tight band securing the hair with the radial projections extending circumferentially around the held hair of the user.

18 Claims, 5 Drawing Sheets

DECORATIVE PONY TAIL HOLDER AND METHOD OF USING

FIELD OF THE INVENTION

The present invention relates to a decorative pony tail holder for securing the hair of a user relatively tightly in a decorative manner to simulate the petals of a flower, a star or the like with a relatively slim profile, and method of use.

BACKGROUND OF THE INVENTION

Pony tail holders formed of an elastic band having a relatively large amount of bunched fabric therearound to provide a decorative fashion accessory are known, and such items are disclosed, for example, in U.S. design Pat. Nos. Des. 292,030, Des. 315,036; and Des. 315,226. Additionally the applicant has filed application Ser. No. 935,029 on Aug. 25, 1992 which discloses a fashion accessory which can be used as a decorative pony tail holder.

Generally, the user of such decorative pony tail holders will often twist the elastic band and fold it over itself to provide a fairly secure grip to a length of hair held by the elastic band; and it is often difficult to provide a high-fashion and decorative arrangement of fabric around the elastic band which will not become too bulky when the elastic band is twisted over itself to tightly secure the hair. It is, therefore, an object of the present invention to provide a decorative pony tail holder which can secure a length of hair by twisting the elastic band over itself to provide a tight grip for the hair while simultaneously providing a decorative display which will not become too bulky as to disrupt the position of the length of hair held by the twisted elastic band.

SUMMARY OF THE INVENTION

According to the present invention, a decorative pony tail holder and method for securely holding the hair of the user comprises a band of elastic material with fabric around this band. The fabric is formed into a plurality of radial projections extending circumferentially around a portion of the band to provide a circumferential portion of the band without any of these radial projections. In this way, a length of hair of the user may be inserted through the band with the band twisted over itself to tightly hold the hair with the projections encircling the length of hair. In this way, a sculpture of fabric can be provided to simulate such items as the petals of a flower or a star without becoming unduly bulky as the elastic band is twisted over itself in order to tightly grip the hair of the user.

Preferably, the radial projections are spaced equally around a portion of the elastic band, and in one embodiment of the present invention the radial projections have substantially rounded ends so that the projections will simulate the petals of a flower when the band is twisted over itself to tightly grip the hair of the user; and in another embodiment of the present invention, the free ends of the radial projections are configured more sharply to simulate a star when placed around the user's hair.

BRIEF DESCRIPTION OF THE DRAWINGS

These are other objects, features, and advantages of the present invention will become apparent from the description of preferred embodiments, such descriptions being made with reference to the following drawing figures, in which.

DETAILED DESCRIPTION OF PREFERRED EMBODIMENTS

Figure 1:
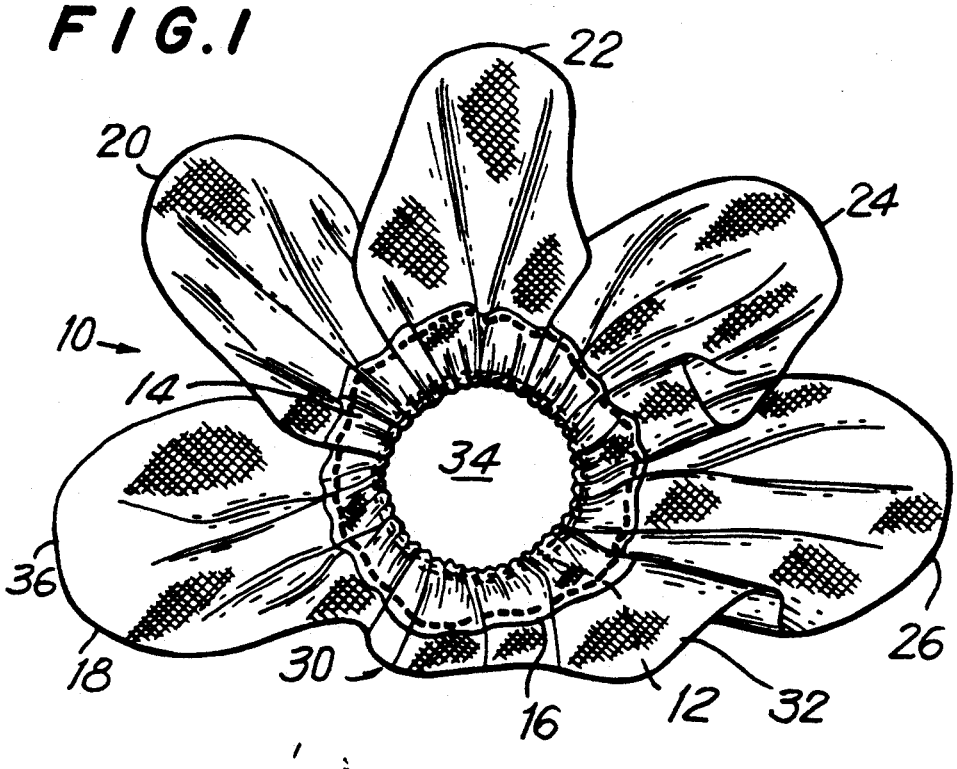
FIG. 1 illustrates a decorative pony tail holder of the present invention in elevation.

As illustrated in FIG. 1, a decorative pony tail holder 10 of the present invention includes an internal elastic band 12 shown in phantom. A ring 14 of fabric surrounds and substantially encases the elastic band 12. As will be understood in the art, the ring 14 of fabric is formed by a length of fabric material extending circumferentially around the elastic band 12 and folded over the elastic band and stitch closed around its outer rim portion 16 to encase the elastic band in a substantially free-floating condition. Stitched to the outer edge of the fabric ring 16 is a continuous length of fabric formed into radial projections 18, 20, 22, 24, and 26. The length of fabric forming the radial projections is preferably formed as a double length of fabric which is stitched along its outer edge with an inner seam; and stitched to the fabric ring 14 to provide a unitary device. A portion 30 of the length of fabric does not include any radial projections, but does include a small segment 32 of fabric material.

Figure 2:
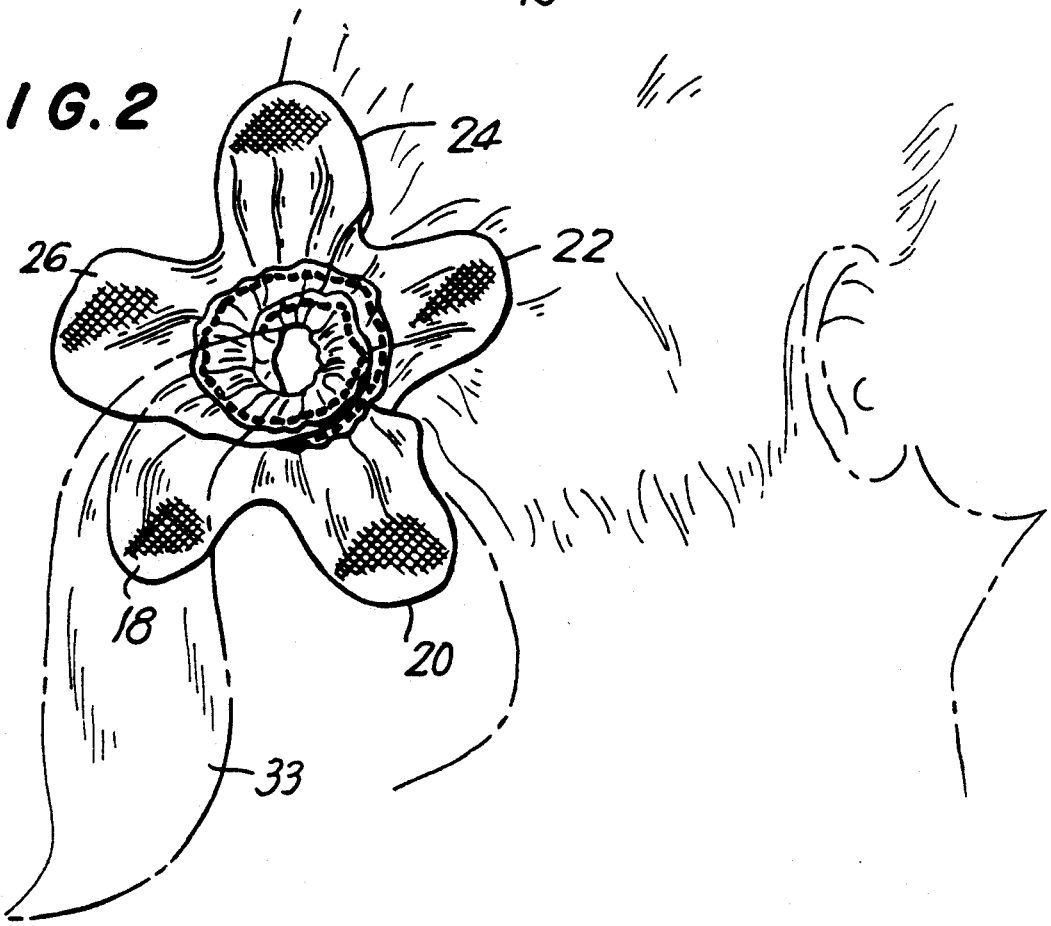
FIG. 2 illustrates the embodiment of the present invention illustrated in FIG. 1 in place upon the user's hair.

FIG. 2 illustrates the embodiment of FIG. 1 in operative position as a pony tail holder, and as can be seen from FIG. 2, the pony tail holder is manipulated around a bunched length of hair 33 of the user to position the radial projections 18 through 26 in substantially uniformly-spaced circumferential arrangement around the pony tail 33.

Figure 3:
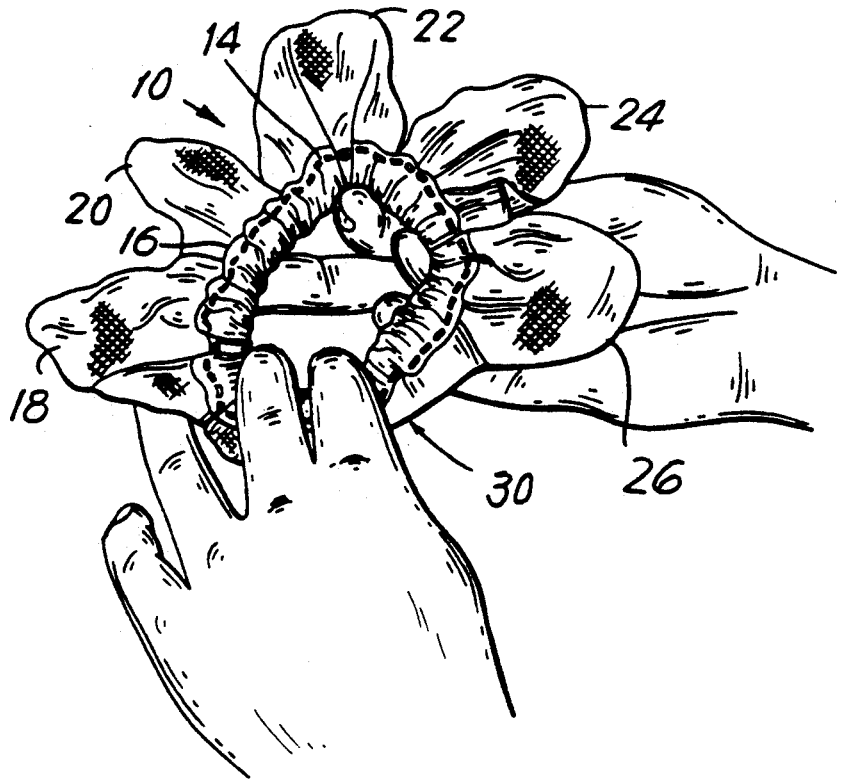
FIG. 3 illustrates the initial steps of applying the decorative pony tail holder and FIG. 1 to the user's hair.
Figure 4:
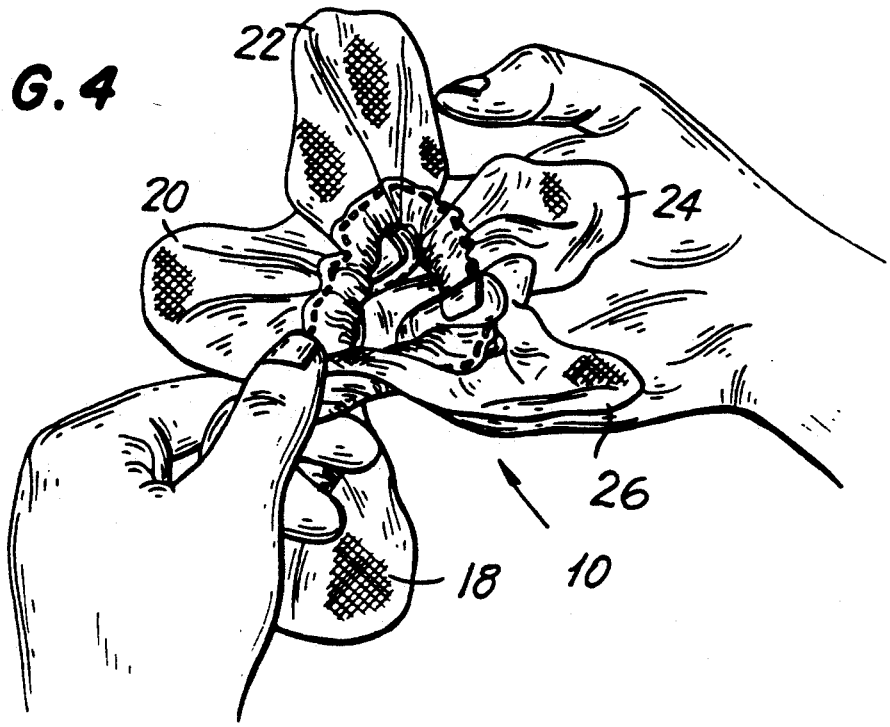
FIGS. 4 and 5 illustrate the twisting of the decorative pony tail holder of FIG. 1.
Figure 5:
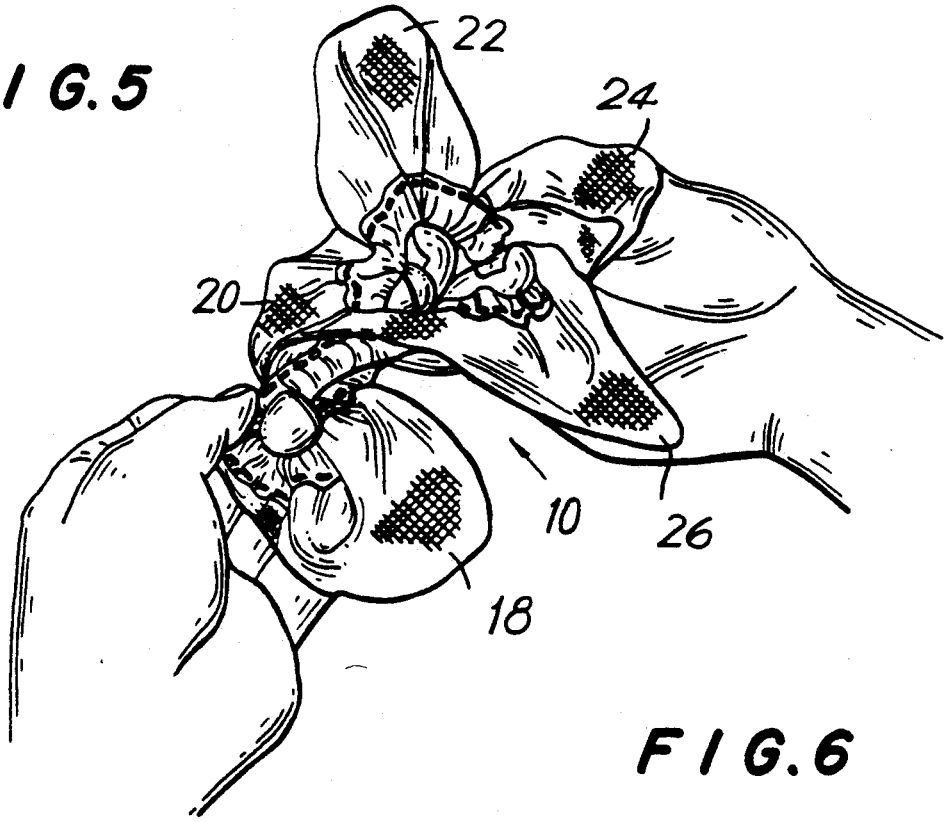
Figure 6:
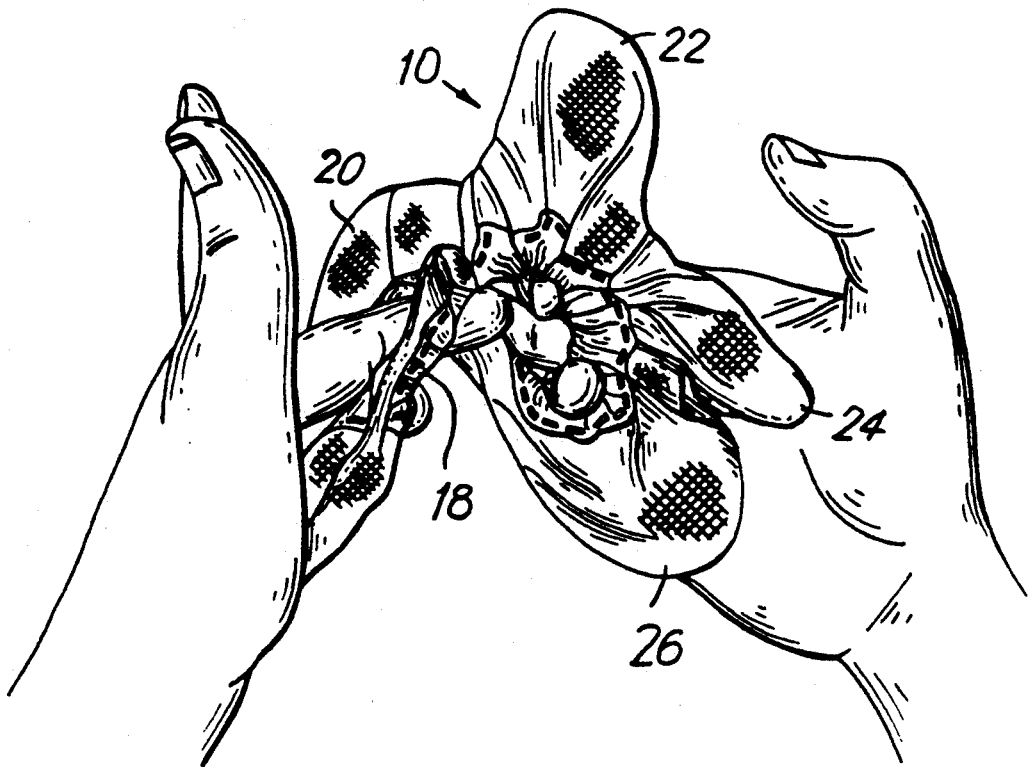
FIG. 6 illustrates the placing of the twisted pony tail holder of FIG. 1 over itself.
Figure 7:
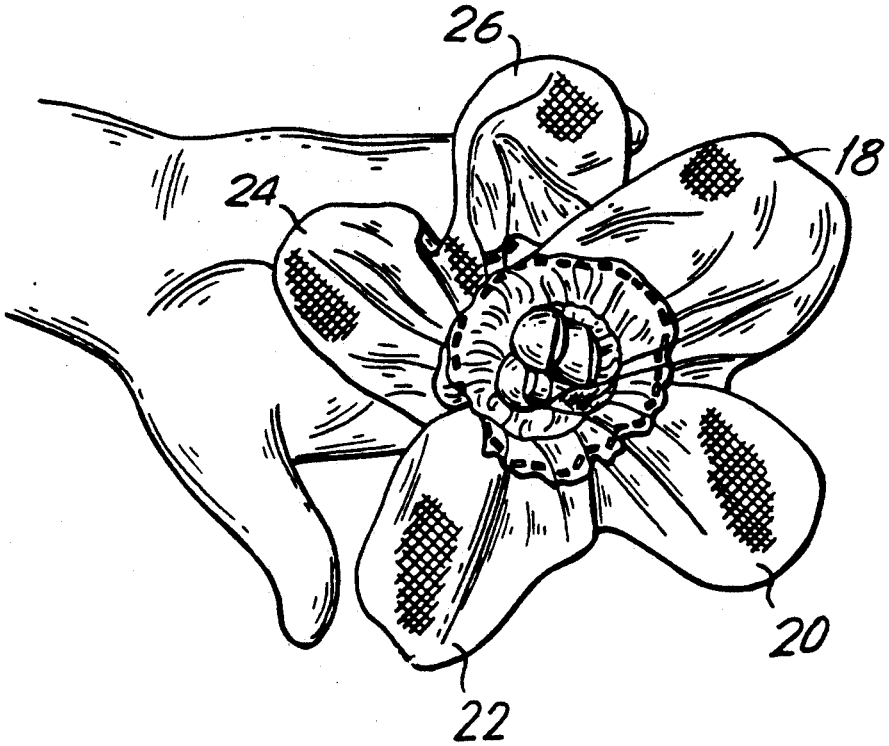
FIG. 7 illustrates the fully twisted and assembled condition of the pony tail holder of FIG. 1.
Figure 8:
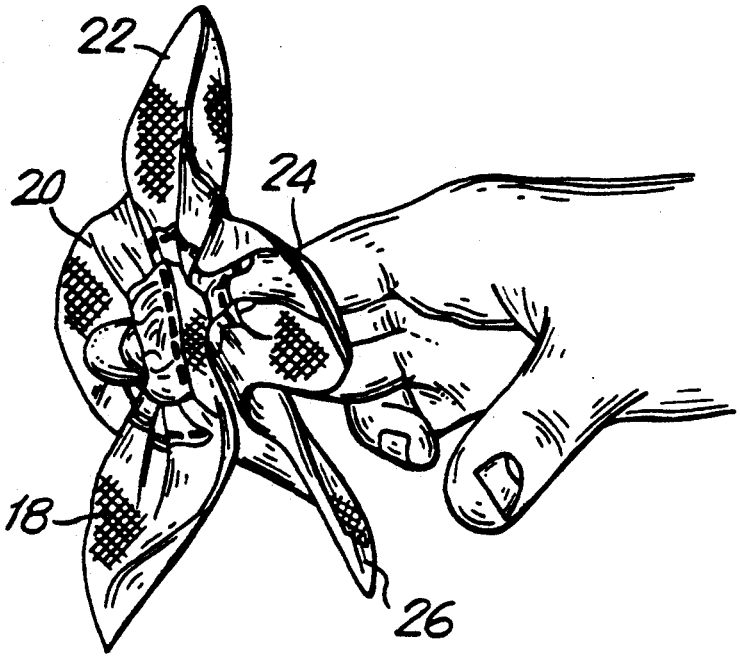
FIG. 8 is a side view of FIG. 7.

To position the decorative pony tail holder 10 of the present invention in the operative position illustrated in FIG. 2, the length of hair 33 is first inserted through the opening 34 formed centrally in the pony tail holder 10, and the opening 34 can be stretched by pulling downward, for example, as illustrated in FIG. 3 with the lower portion of the pony tail holder twisted to generally form a figure-eight configuration as illustrated in FIG. 4. As illustrated in FIG. 5, the generally figure-eight configuration can be further twisted to invert the radial projections 18 and 20. As illustrated in FIG. 6, the lower half of the figure-eight formed by twisting the elastic band can then be placed over the upper portion of the figure eight as illustrated in FIG. 7, with the pony tail 33 projecting through the two overlaid openings from the figure-eight as previously formed; as illustrated in FIG. 2. In this way, the radial projections 18 through 26 can be arranged circumferentially in a position around the pony tail 32 to provide a decorative display of fabric and yet, as can be illustrated in FIG. 8, the thickness of the pony tail holder will not be too bulky despite the twisting and folding upon itself of the elastic band 12.

Figure 9:
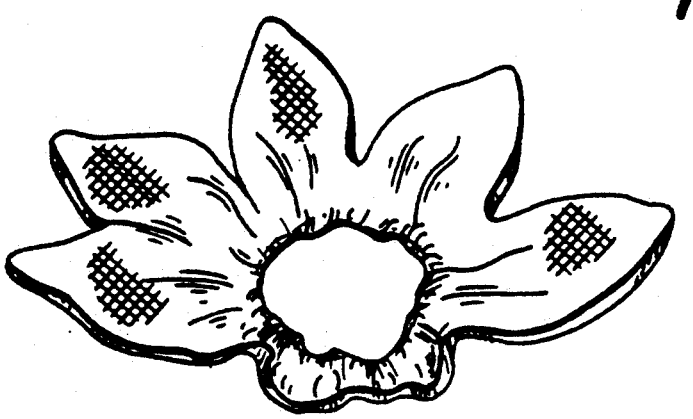
FIG. 9 illustrates another embodiment of the present invention to illustrate a star.
Figure 10:
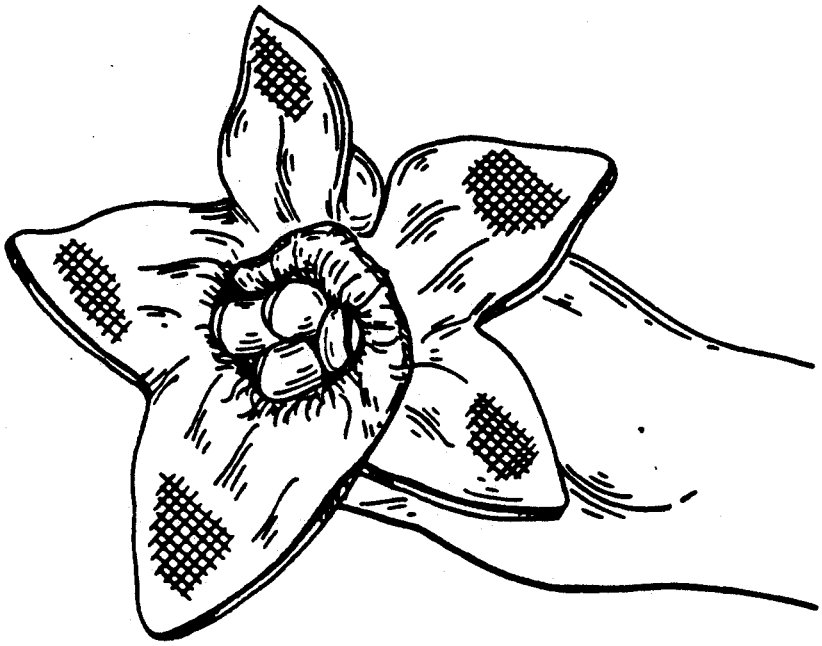
FIG. 10 illustrates the position in use of the embodiment of FIG. 9.

The embodiment of the present invention illustrated in FIGS. 1 through 8 includes rounded free ends such as the end 36 of the radial projection 18 illustrated in FIG. 1; and thus the embodiment of this invention will simulate generally the appearance of the petals of a flower when positioned in the user's hair as illustrated in FIG. 2. FIG. 9 illustrates an alternate embodiment of the present invention wherein the radial projections are more sharply formed at the free end so that, as illustrated in FIG. 10, the device when positioned in the user's hair may generally simulate a five-pointed star.

As would be understood by one skilled in the art, the sculptural designs that can be utilized in the present invention are many and varied, and the invention is not intended to be limited to any particle pattern for the fabric chosen, nor any particular sculptular designs which could be configured by the general structures and geometry of the present invention described herein. The invention is not intended to be limited by any of the details described above, but by the appended claims.

I claim:

1. A decorative pony tail holder for securely holding the hair of a user, comprising:

a band of elastic material defining a central opening, said band having first and second portions, fabric surrounding said band, said fabric being formed into a plurality of radial projections extending circumferentially about said first position of said band, said second portion of said band being free of radial projections along its length so that a length of hair of a user may be inserted through said band with said band inverted over itself to tightly hold the hair while providing said projections around substantially the entire circumference of the held hair.

2. A decorative pony tail holder as set forth in claim 1, said radial projections being spaced equally distant from one another.

3. A decorative pony tail holder as set forth in claim 2, the free ends of said radial projections being generally rounded.

4. A decorative pony tail holder set forth in claim 2, said radial projections extending to a relatively pointed free end.

5. A decorative pony tail holder set forth in claim 1, the free ends of said radial projections being generally rounded.

6. A decorative pony tail holder as in claim 1, said radial projections extending to a relatively pointed free end.

7. A method for providing a decorative pony tail holder for securing the hair of a user, comprising the steps of:

providing a band of elastic material with fabric surrounding said band to form a central opening, said band having first and second portions, said fabric being formed into a plurality of radial projections extending circumferentially around said first portion of said band, said second portion of said band being free of radial projections along its length, placing a length of hair of the user through said central opening in said pony tail holder, twisting said elastic band with surrounding fabric into a generally figure-eight configuration, folding said twisted band over itself, and extending said length of hair through said folded elastic band to position said radial projections around the circumference of the held hair.

8. The method as set forth in claim 7, wherein said radial projections are spaced equally distant from one another.

9. The method as set forth in claim 8, wherein the free ends of said radial projections are generally rounded.

10. The method as set forth in claim 8, wherein said radial projections extend to a relatively pointed free end.

11. The method as set forth in claim 7, wherein the free ends of said radial projections are generally rounded.

12. The method as set forth in claim 7, wherein said radial projections extend to a relatively pointed free end.

13. A method for providing a decorative pony tail for securing the hair of a user, comprising the steps of:

providing a band of elastic material with fabric surrounding said band to form a central opening, said band having a first and second portion, said fabric being formed into a plurality of radial projections extending circumferentially around said first portion of said band, said second portion of said band being free of radial projections along its length, twisting said elastic band into a generally figure-eight configuration, folding said twisted band over itself, and extending a length of hair through said folded elastic band to position said radial projections around the circumference of the held hair.

14. The method as set forth in claim 13, wherein said radial projections are spaced equally distant from one another.

15. The method as set forth in claim 14, wherein the free ends of said radial projections are generally rounded.

16. The method as set forth in claim 14, wherein said radial projections extend to a relatively pointed free end.

17. The method as set forth in claim 13, wherein the free ends of said radial projections are generally rounded.

18. The method as set forth in claim 13, wherein said radial projections extend to a relatively pointed free end.

* * * * *